US006774849B2

(12) United States Patent
Umehara et al.

(10) Patent No.: US 6,774,849 B2
(45) Date of Patent: Aug. 10, 2004

(54) INVENTED-F PLATE ANTENNA AND WIRELESS COMMUNICATION DEVICE

(75) Inventors: Naoko Umehara, Takatsuki (JP); Hisamatsu Nakano, 4-6-7-101, Jyousuiminami-cho, Kodaira-Shi, Tokyo (JP)

(73) Assignees: Sharp Kabushiki Kaisha, Osaka (JP); Hisamatsu Nakano, Tokyo (JP)

( * ) Notice: Subject to any disclaimer, the term of this patent is extended or adjusted under 35 U.S.C. 154(b) by 20 days.

(21) Appl. No.: 10/235,640

(22) Filed: Sep. 6, 2002

(65) Prior Publication Data

US 2003/0052827 A1 Mar. 20, 2003

(30) Foreign Application Priority Data

Sep. 18, 2001 (JP) ..... 2001-283597

(51) Int. Cl.[7] ..... H01Q 1/38

(52) U.S. Cl. ..... 343/700 MS; 343/702; 343/846

(58) Field of Search ..... 343/700 MS, 702, 343/829, 846, 848

(56) References Cited

U.S. PATENT DOCUMENTS

| | | | | | |
|---|---|---|---|---|---|
| 5,912,647 | A | * | 6/1999 | Tsuru et al. | 343/700 MS |
| 6,255,994 | B1 | * | 7/2001 | Saito | 343/700 MS |
| 6,408,190 | B1 | * | 6/2002 | Ying | 455/553.1 |
| 6,437,747 | B1 | * | 8/2002 | Stoiljkovic et al. | 343/702 |
| 6,452,558 | B1 | * | 9/2002 | Saitou et al. | 343/725 |
| 2002/0000938 | A1 | * | 1/2002 | Hoashi et al. | 343/700 MS |

FOREIGN PATENT DOCUMENTS

| | | |
|---|---|---|
| JP | H8-250917 | 9/1996 |
| JP | 2000-114860 | 4/2000 |

* cited by examiner

*Primary Examiner*—Tho Phan
(74) *Attorney, Agent, or Firm*—Nixon & Vanderhye P.C.

(57) ABSTRACT

A ground pattern 8 has a portion thereof removed in an area 13 where an inverted-F plate antenna 1 is mounted. This gives the inverted-F plate antenna 1 almost non-directional directivity patterns as distinct from those obtained with an ordinary inverted-F antenna, and helps achieve a higher degree of gain isotropy.

57 Claims, 13 Drawing Sheets

INVENTED-F PLATE ANTENNA AND WIRELESS COMMUNICATION DEVICE

BACKGROUND OF THE INVENTION

1. Field of the Invention

The present invention relates to an antenna for wireless communication for use in a portable terminal device such as a cellular telephone or PDA (personal digital assistant) or in a PC (personal computer) or CF (compact flash) card provided with communication capability. The present invention relates particularly to an inverted-F plate antenna. The present invention relates also to a wireless communication device incorporating such an inverted-F plate antenna.

2. Description of the Prior Art

In wireless communication devices such as cellular telephones, to miniaturize the devices, it is customary to mount an antenna on a printed circuit board on which circuits for achieving various functions are mounted. One type of antenna that is mounted on a printed circuit board is an inverted-F plate antenna, which has the advantage of occupying a small volume. FIG. 17 shows a typical shape of such an inverted-F plate antenna.

As shown in FIG. 17, on a printed circuit board 7 having a ground pattern 8*h* formed over its top surface, an inverted-F plate antenna 1 having an elongate conductor portion 1*a* is mounted. This inverted-F plate antenna 1 is formed by cutting a piece of metal having an appropriate shape out of sheet metal and then bending it into the desired shape so as to have a grounding conductor portion 1*b* and a feeding conductor portion 1*d*. The grounding conductor portion 1*b* has a mounting conductor portion 1*c* formed at the free end thereof and connected to a ground pattern 8*h*, and the feeding conductor portion 1*d* has a mounting conductor portion 1*e* formed at the free end thereof and connected to a feeding point 9. In this way, the grounding conductor portion 1*b* and the feeding conductor portion 1*d* are formed perpendicular to the elongate conductor portion 1*a*, which is arranged parallel to the printed circuit board 7, thereby forming an inverted-F shape.

Moreover, between the inverted-F plate antenna 1 thus mounted and the printed circuit board 7, a non-metallic spacer 6 is inserted to keep the inverted-F plate antenna 1 securely in position and to determine the gap between the inverted-F plate antenna 1 and the printed circuit board 7. This spacer 6 is inserted between the elongate conductor portion 1*a* of the inverted-F plate antenna 1 and the printed circuit board 7, and is located away from the grounding conductor portion 1*b* and the feeding conductor portion 1*d*.

Many antennas have a main plane of polarization, and exhibit a lower gain for radio waves polarized perpendicularly to the plane of polarization (in the present specification, a "gain" denotes not the gain in a single direction but the average gain in all directions). For example, a dipole antenna as shown in FIG. 18 exhibits directivity patterns as shown in FIG. 19. Specifically, this antenna exhibits a significant gain mainly for vertically polarized radio waves as indicated by a solid line and a low gain for horizontally polarized radio waves as indicated by a broken line. That is, theoretically, a perfect linear dipole antenna exhibits no gain for horizontally polarized radio waves. On the other hand, a monopole antenna having infinite expanses of ground as shown in FIG. 20 exhibits a radiating pattern only above the ground surface, and exhibits no directivity pattern below the ground surface. It is to be noted that the direction parallel to the printed circuit board 7 will be referred to as horizontal.

The inverted-F plate antenna 1 shown in FIG. 17 exhibits directivity patterns similar to those of the monopole antenna shown in FIG. 20, and thus exhibits a low gain on the side of the printed circuit board 7 facing away from the antenna 1 and for horizontally polarized radio waves polarized parallel to the printed circuit board 7. For this reason, the inverted-F plate antenna 1 shown in FIG. 17 or a similar antenna radiates radio waves with comparatively low signal strength in the direction parallel to the printed circuit board 7. Accordingly, in a wireless communication device incorporating such an inverted-F plate antenna 1, so long as the device is supposed to be used in a particular position, the inverted-F plate antenna 1 is so arranged as to exhibit a gain in the desired direction when the device is placed in that particular position.

However, when an antenna is incorporated in a CF card provided with wireless communication capability and the CF card is used while being inserted into a PDA, or when an antenna is incorporated in a PDA provided with wireless communication capability and this PDA is used, as shown in FIG. 21, the PDA may be used in any position, for example, while being held vertically or horizontally or placed on a desk. In FIG. 21, reference numeral 150 represents a PDA, and reference numeral 151 represents a base station. Ideally, an antenna like this incorporated in a CF card or PDA should be able to transmit and receive both vertically and horizontally polarized radio waves, and its directivity patterns should not be lopsided in a particular direction but be spherical, i.e., uniform in all directions.

These aims can be achieved, for example, with a diversity system, i.e., by providing two antennas, one having the main plane of polarization in the horizontal direction and the other having the main plane of polarization in the vertical direction, and choosing whichever is offering better reception at every moment. However, where miniaturization is crucial as in a CF card, an antenna incorporated therein needs to be as compact and simple as possible, and therefore a diversity system, which requires two antennas, is unsuitable.

SUMMARY OF THE INVENTION

An object of the present invention is to provide an inverted-F plate antenna that exhibits a uniform gain in all directions and that exhibits less lopsided directivity patterns than ever, and to provide a wireless communication device incorporating such an inverted-F plate antenna.

To achieve the above object, according to one aspect of the present invention, an inverted-F plate antenna is provided with: an elongate conductor portion provided so as to face a printed circuit board; a grounding conductor portion provided at one side of the elongate conductor portion and electrically connected to a ground pattern formed on the printed circuit board; a feeding conductor portion provided at one side of the elongate conductor portion and electrically connected to a feeding point formed on the printed circuit board. Here, the ground pattern formed on the printed circuit board has a portion thereof removed in part of the area on the printed circuit board facing the elongate conductor portion.

According to another aspect of the present invention, a wireless communication device is provided with: an inverted-F plate antenna for at least either transmitting a communication signal to outside or receiving a communication signal from outside. The inverted-F plate antenna is provided with: an elongate conductor portion provided so as to face a printed circuit board; a grounding conductor portion provided at one side of the elongate conductor portion and electrically connected to a ground pattern formed on the printed circuit board; a feeding conductor portion provided at one side of the elongate conductor portion and electrically connected to a feeding point formed on the printed circuit board. Here, the ground pattern formed on the printed circuit board has a portion thereof removed in part of an area on the printed circuit board facing the elongate conductor portion.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

First Embodiment

Figure 1:
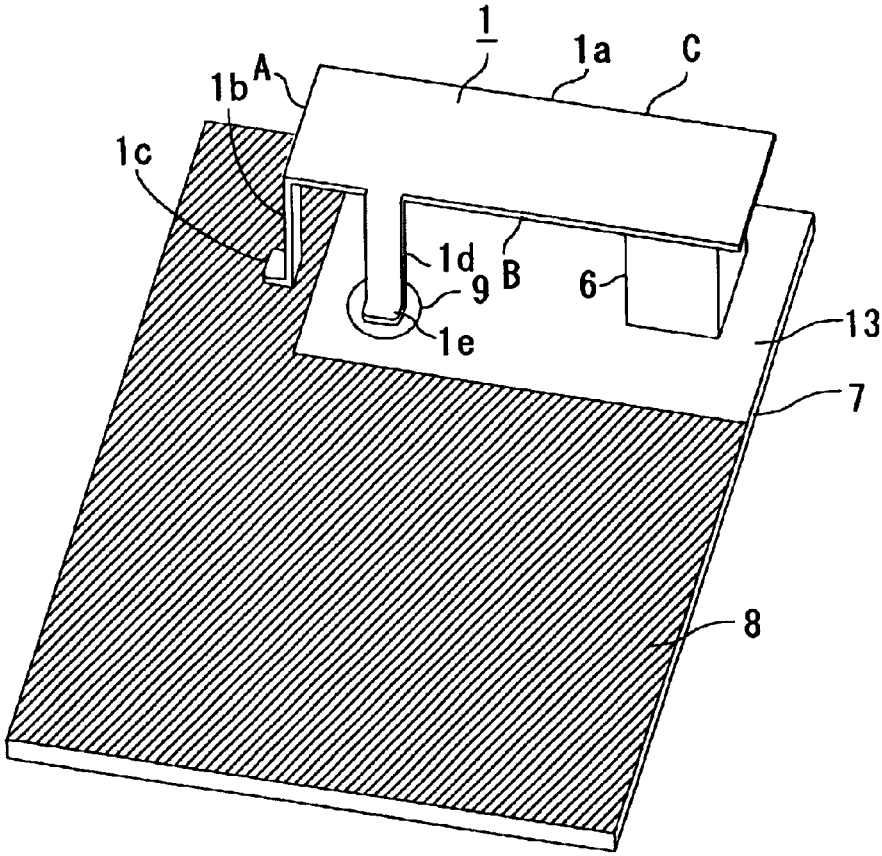
FIG. 1 is an external perspective view of the inverted-F plate antenna of a first embodiment of the invention, in its mounted state.

A first embodiment of the present invention will be described below with reference to the drawings. FIG. 1 is an external perspective view of the inverted-F plate antenna of this embodiment.

Figure 17:
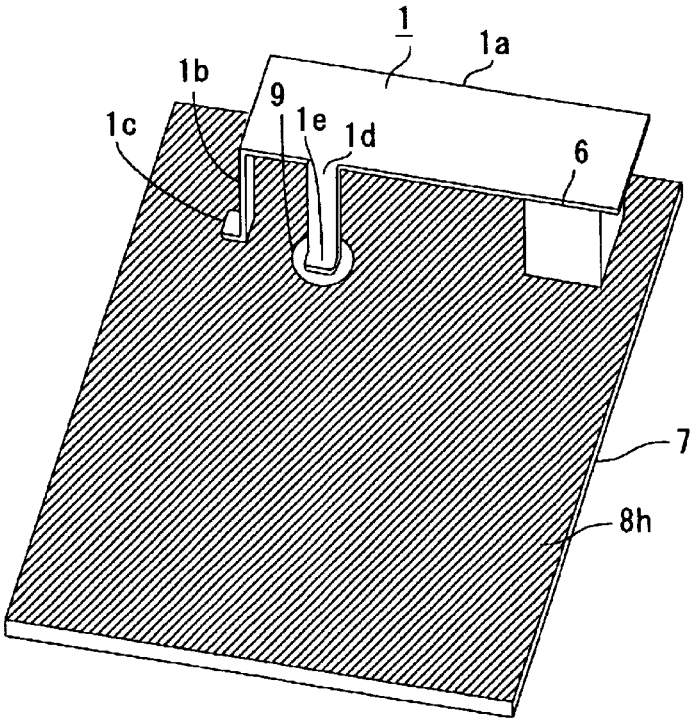
FIG.17 PRIOR ART
FIG. 17 is an external perspective view of a conventional inverted-F plate antenna, in its mounted state.
Figure 18:
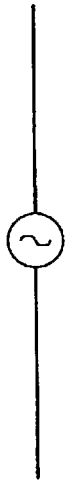
FIG.18 PRIOR ART
FIG. 18 is a diagram showing a dipole antenna.
Figure 19:
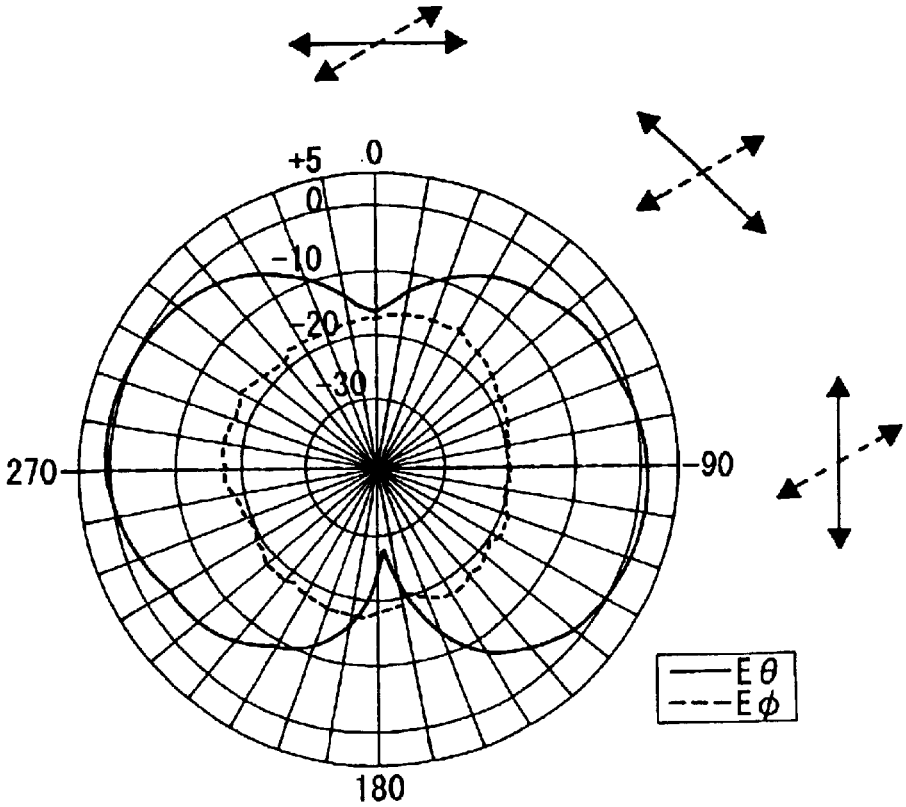
FIG.19 PRIOR ART
FIG. 19 is a diagram showing the directivity patterns of the dipole antenna shown in FIG. 18.
Figure 20:
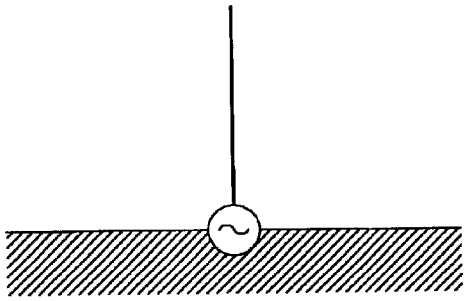
FIG.20 PRIOR ART
FIG. 20 is a diagram showing a monopole antenna.
Figure 21:
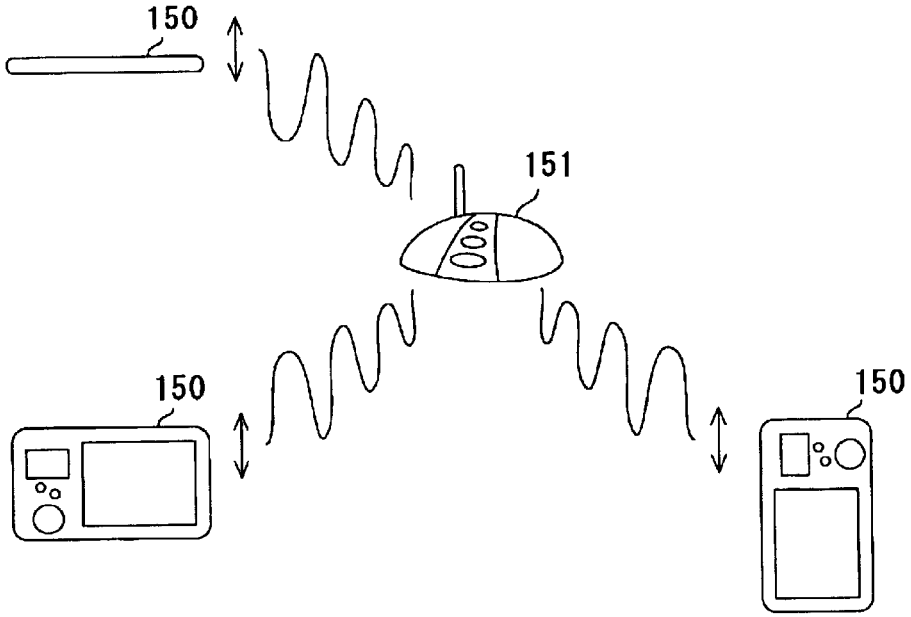
FIG.21 PRIOR ART
FIG. 21 is a diagram showing a PDA performing transmission and reception.

As shown in FIG. 1, the inverted-F plate antenna 1 is mounted on a printed circuit board 7 having a ground pattern 8 formed over its top surface. Here, the ground pattern 8, unlike that shown in FIG. 17, is so shaped as to avoid an area 13 in which the inverted-F plate antenna 1 is mounted. Thus, in the area 13 on the printed circuit board 7, a dielectric layer is exposed on the surface. Moreover, in the area 13 on the printed circuit board 7, a feeding point 9 is provided.

The inverted-F plate antenna 1 is formed by cutting a piece of metal having an appropriate shape out of sheet metal and then bending it into the desired shape so as to have an elongate conductor portion 1*a*, a grounding conductor portion 1*b*, and a feeding conductor portion 1*d*. The grounding conductor portion 1*b* has a mounting conductor portion 1*c* formed at the free end thereof and connected to the ground pattern 8, and the feeding conductor portion 1*d* has a mounting conductor portion 1*e* formed at the free end thereof and connected to the feeding point 9. In this way, the grounding conductor portion 1*b* and the feeding conductor portion 1*d* are formed perpendicular to the elongate conductor portion 1*a*, which is arranged parallel to the printed circuit board 7, thereby forming an inverted-F shape.

Here, the grounding conductor portion 1*b* has a smaller width than the side A of the elongate conductor portion 1*a*, and the mounting conductor portions 1*c* and 1*e* have the same widths as the grounding and feeding conductor portions 1*b* and 1*d*, respectively. The grounding conductor portion 1*b* is provided at an end of the side A of the elongate conductor portion 1*a*, and the feeding conductor portion 1*d* is provided somewhat away from an end of the side B of the elongate conductor portion 1*a* where the grounding conductor portion 1*b* is provided. The mounting conductor portions 1*c* and 1*e* are formed by bending the free ends of the grounding and feeding conductor portions 1*b* and 1*d*, respectively.

Moreover, between the inverted-F plate antenna 1 thus mounted and the printed circuit board 7, a non-metallic spacer 6 is inserted to keep the inverted-F plate antenna 1 securely in position and to determine the gap between the inverted-F plate antenna 1 and the printed circuit board 7. This spacer 6 is inserted between the elongate conductor portion 1*a* of the inverted-F plate antenna 1 and the printed circuit board 7, and is located away from the grounding and feeding conductor portions 1*b* and 1*d*.

In this structure, unlike that shown in FIG. 17, there is no ground pattern in the area 13 right under the elongate conductor portion 1*a*. As a result, the directivity patterns obtained are almost non-directional, as distinct from those obtained with an ordinary inverted-F antenna. Specifically, if the direction parallel to the printed circuit board 7 is assumed to be horizontal, the directivity patterns obtained are not such that a high gain is obtained in the horizontal direction and a low gain on the bottom side of the printed circuit board 7. Moreover, a higher gain is obtained for horizontally polarized radio waves than with the structure shown in FIG. 17.

Figure 2:
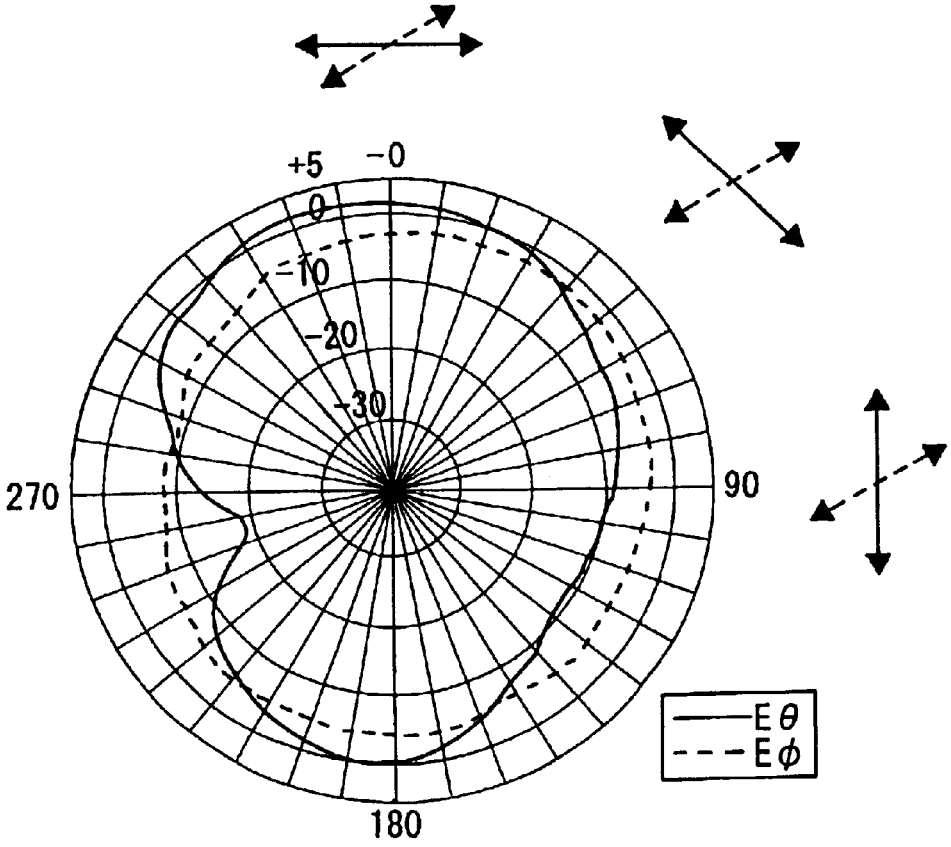
FIG. 2 is a diagram showing the directivity patterns of the inverted-F plate antenna shown in FIG. 1.

Thus, as indicated by a solid line in FIG. 2, a roughly circular directivity pattern is obtained for vertically polarized radio waves and, as indicated by a broken line, a roughly circular directivity pattern is obtained for horizontally polarized radio waves, resulting in roughly spherical directivity patterns as a whole. That is, a structure like that shown in FIG. 1 exhibits directivity patterns as shown in FIG. 2, achieving high degree of isotropy for both vertically and horizontally polarized radio waves.

Second Embodiment

Figure 3:
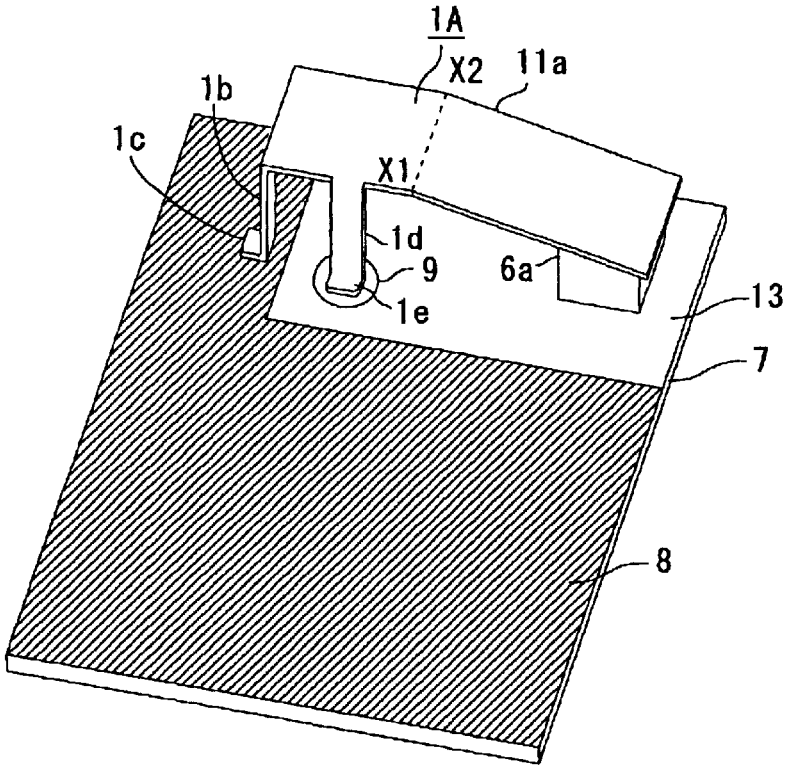
FIG. 3 is an external perspective view of the inverted-F plate antenna of a second embodiment of the invention, in its mounted state.

A second embodiment of the present invention will be described below with reference to the drawings. FIG. 3 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1A is mounted on a printed circuit board 7 having a ground pattern 8 formed over its top surface except in an area 13 as in the first embodiment (FIG. 1). This inverted-F plate antenna 1A, like the inverted-F plate antenna 1 of the first embodiment, has an elongate conductor portion 11*a*, a grounding conductor portion 1*b* having a mounting conductor portion 1*c*, and a feeding conductor portion 1*d* having a mounting conductor portion 1*e*. The elongate conductor portion 11*a* is bent along a line X1–X2 so that its free end, i.e., the side opposite to the side A where the grounding conductor portion 1*b* is provided, comes closer to the printed circuit board 7. Between the free end of this elongate conductor portion 11*a* and the printed circuit board 7, a spacer 6*a* is provided. This spacer 6*a* has a smaller height than the spacer 6 shown in FIG. 1.

The elongate conductor portion 11*a* of this inverted-F plate antenna 1A is formed by bending the elongate conductor portion 1*a* shown in FIG. 1 along the line X1–X2. As a result, when viewed from above the printed circuit board 7, the area occupied by the elongate conductor portion 11*a*, which determines the size of the inverted-F plate antenna 1A, is smaller than the area occupied by the elongate conductor portion 1*a*, which determines the size of the inverted-F plate antenna 1 shown in FIG. 1. Moreover, since the elongate conductor portion 11*a* is so formed that its free end comes closer to the printed circuit board 7, the volume occupied by the inverted-F plate antenna 1A is smaller than the volume occupied by the inverted-F plate antenna 1 shown in FIG. 1. These features help miniaturize the antenna, and help increase the flexibility in the design of where to locate the supporting posts of the cabinet in which the printed circuit board 7 is housed.

Third Embodiment

Figure 4:
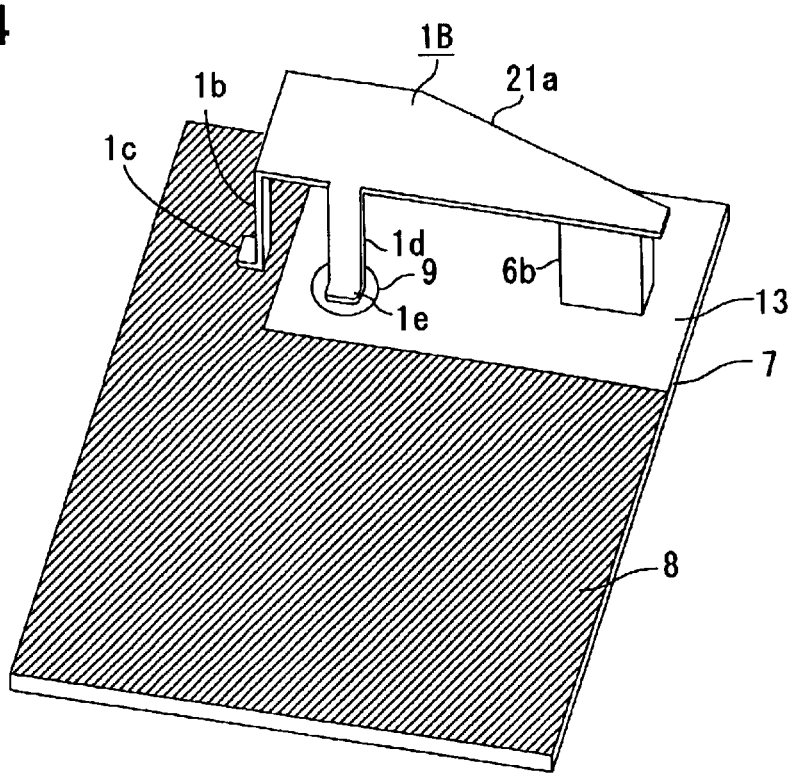
FIG. 4 is an external perspective view of the inverted-F plate antenna of a third embodiment of the invention, in its mounted state.

A third embodiment of the present invention will be described below with reference to the drawings. FIG. 4 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1B is mounted on a printed circuit board 7 having a ground pattern 8 formed over its top surface except in an area 13 as in the first embodiment (FIG. 1). This inverted-F plate antenna 1B, like the inverted-F plate antenna 1 of the first embodiment, has an elongate conductor portion 21*a*, a grounding conductor portion 1*b* having a mounting conductor portion 1*c*, and a feeding conductor portion 1*d* having a mounting conductor portion 1*e*. The elongate conductor portion 21*a* is so shaped that its width decreases toward its free end, i.e., away from where the grounding conductor portion 1*b* is provided. Between the free end of this elongate conductor portion 21*a* and the printed circuit board 7, a spacer 6*b* is provided. This spacer 6*b* occupies a smaller area between the elongate conductor portion 21*a* and the printed circuit board 7 than the spacer 6 shown in FIG. 1.

The elongate conductor portion 21*a* of this inverted-F plate antenna 1B is formed by cutting the C side, i.e. the side opposite to the B side where the feeding conductor portion 1*d* is provided, of the elongate conductor portion 1*a* shown in FIG. 1. As a result, when viewed from above the printed circuit board 7, the area occupied by the elongate conductor portion 21*a*, which determines the size of the inverted-F plate antenna 1B, is smaller than the area occupied by the elongate conductor portion 1*a*, which determines the size of the inverted-F plate antenna 1 shown in FIG. 1. Thus, the volume occupied by the inverted-F plate antenna 1B is smaller than the volume occupied by the inverted-F plate antenna 1 shown in FIG. 1. These features help miniaturize the antenna, and help increase the flexibility in the design of where to locate the supporting posts of the cabinet in which the printed circuit board 7 is housed.

Fourth Embodiment

Figure 5:
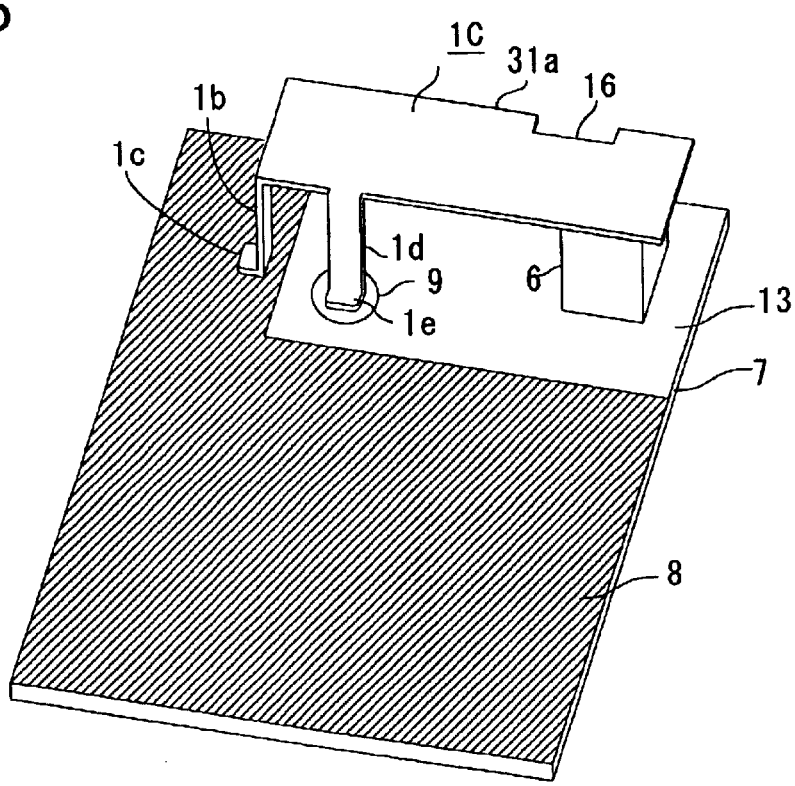
FIG. 5 is an external perspective view of the inverted-F plate antenna of a fourth embodiment of the invention, in its mounted state.

A fourth embodiment of the present invention will be described below with reference to the drawings. FIG. 5 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1C is mounted on a printed circuit board 7 having a ground pattern 8 formed over its top surface except in an area 13 as in the first embodiment (FIG. 1). This inverted-F plate antenna 1C, like the inverted-F plate antenna 1 of the first embodiment, has an elongate conductor portion 31*a*, a grounding conductor portion 1*b* having a mounting conductor portion 1*c*, and a feeding conductor portion 1*d* having a mounting conductor portion 1*e*. The elongate conductor portion 31*a* is so shaped as to have a cut 16 formed in the side C thereof, i.e. the side opposite to the side B where the feeding conductor portion 1*d* is provided. Between the free end of this elongate conductor portion 31*a* and the printed circuit board 7, a spacer 6 is provided.

The elongate conductor portion 31*a* of this inverted-F plate antenna 1C is formed by cutting the side C of the elongate conductor portion 1*a* shown in FIG. 1 so as to form the cut 16. By locating the cut 16 according to where to locate the supporting posts of the cabinet in which the printed circuit board 7 is housed, it is possible to increase the flexibility in the design of the cabinet. Forming the cut 16 in the side opposite to where the feeding conductor portion 1*d* is provided as in this embodiment does not greatly affect the resonance frequency of the antenna, and therefore there is no need to vary the size of the elongate conductor portion 31*a* according to the size of the cut 16.

In this embodiment, the elongate conductor portion 31*a* is formed by forming the cut 16 in the side C of the elongate conductor portion 1*a*. However, the cut 16 may be formed elsewhere than in the side C. For example, forming the cut 16 in the side B of the elongate conductor portion makes the path of the current flowing through the elongate conductor portion longer. This makes it possible to obtain the same resonance frequency as that of the original antenna while reducing the size of the elongate conductor portion.

Fifth Embodiment

Figure 6:
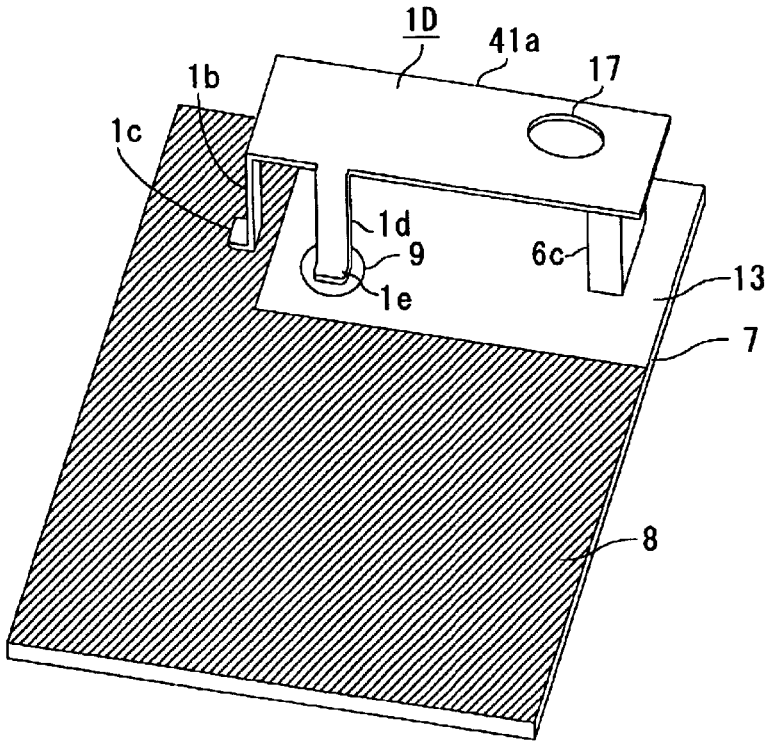
FIG. 6 is an external perspective view of the inverted-F plate antenna of a fifth embodiment of the invention, in its mounted state.

A fifth embodiment of the present invention will be described below with reference to the drawings. FIG. 6 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1D is mounted on a printed circuit board 7 having a ground pattern 8 formed over its top surface except in an area 13 as in the first embodiment (FIG. 1). This inverted-F plate antenna 1D, like the inverted-F plate antenna 1 of the first embodiment, has an elongate conductor portion 41*a*, a grounding conductor portion 1*b* having a mounting conductor portion 1*c*, and a feeding conductor portion 1*d* having a mounting conductor portion 1*e*. The elongate conductor portion 41*a* is so shaped as to have a window 17 formed in a position away from where the grounding and feeding conductor portions 1*b* and 1*d* are provided. Between the free end of this elongate conductor portion 41*a* and the printed circuit board 7, a spacer 6*c* is provided. This spacer 6*c* occupies a smaller area between the elongate conductor portion 41*a* and the printed circuit board 7 than the spacer 6 shown in FIG. 1.

The elongate conductor portion 41*a* of this inverted-F plate antenna 1D is formed by cutting the elongate conductor portion 1*a* shown in FIG. 1 so as to form the window 17. By locating the window 17 according to where to locate the supporting posts of the cabinet in which the printed circuit board 7 is housed, it is possible to increase the flexibility in the design of the cabinet. Forming the window 17 in a position away from where the grounding and feeding conductor portions 1*b* and 1*d* are provided as in this embodiment does not greatly affect the resonance frequency of the antenna, and therefore there is no need to vary the size of the elongate conductor portion 41*a* according to the size of the window 17.

In this embodiment, the elongate conductor portion 41*a* is formed by forming the window 17 in a position away from where the grounding and feeding conductor portions 1*b* and 1*d* are provided. However, the window 17 may be formed elsewhere than in such a position. For example, forming the window 17 in a position close to where the grounding and feeding conductor portions 1*b* and 1*d* are provided makes the path of the current flowing through the elongate conductor portion longer. This makes it possible to obtain the same resonance frequency as that of the original antenna while reducing the size of the elongate conductor portion.

Sixth Embodiment

Figure 7:
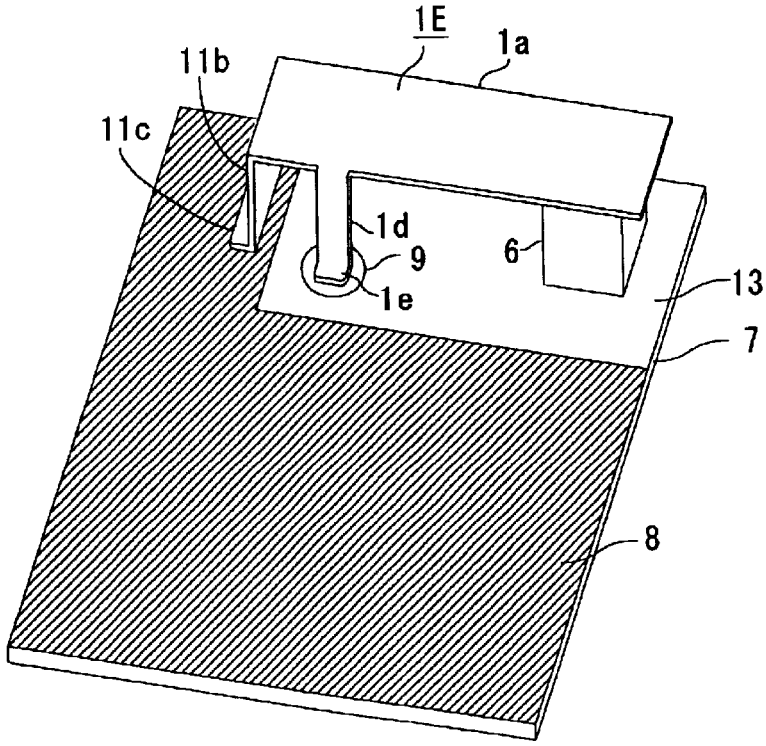
FIG. 7 is an external perspective view of the inverted-F plate antenna of a sixth embodiment of the invention, in its mounted state.

A sixth embodiment of the present invention will be described below with reference to the drawings. FIG. 7 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1E is mounted on a printed circuit board 7 having a ground pattern 8 formed over its top surface except in an area 13 as in the first embodiment (FIG. 1). This inverted-F plate antenna 1E, like the inverted-F plate antenna 1 of the first embodiment, has an elongate conductor portion 1*a*, a grounding conductor portion 11*b* having a mounting conductor portion 11*c*, and a feeding conductor portion 1*d* having a mounting conductor portion 1*e*. The grounding conductor portion 11*b* and the mounting conductor portion 11*c* are each so shaped as to have the same width as the side A of the elongate conductor portion 1*a*. Moreover, between the free end of the elongate conductor portion 1*a* and the printed circuit board 7, a spacer 6 is provided.

When the grounding conductor portion 11*b* and the mounting conductor portion 11*c* of this inverted-F plate antenna 1E are formed, there is no need to cut them out of sheet metal so as to have different widths from the elongate conductor portion 1*a* as when the grounding conductor portion 1*b* and the mounting conductor portion 1*c* of the inverted-F plate antenna 1 are formed. That is, simply by bending a portion of sheet metal so cut out as to have the same width as the side A of the elongate conductor portion 1*a*, it is possible to form the grounding conductor portion 11*b* and the mounting conductor portion 11*c*. This makes it easy to form the grounding conductor portion 11*b* and the mounting conductor portion 11*c*. Moreover, since the mounting conductor portion 11*c* now has a larger width, the antenna 1E can be kept in position more securely, eliminating the need for the spacer 6 in cases where the elongate conductor portion 1*a* is short.

Seventh Embodiment

Figure 8:
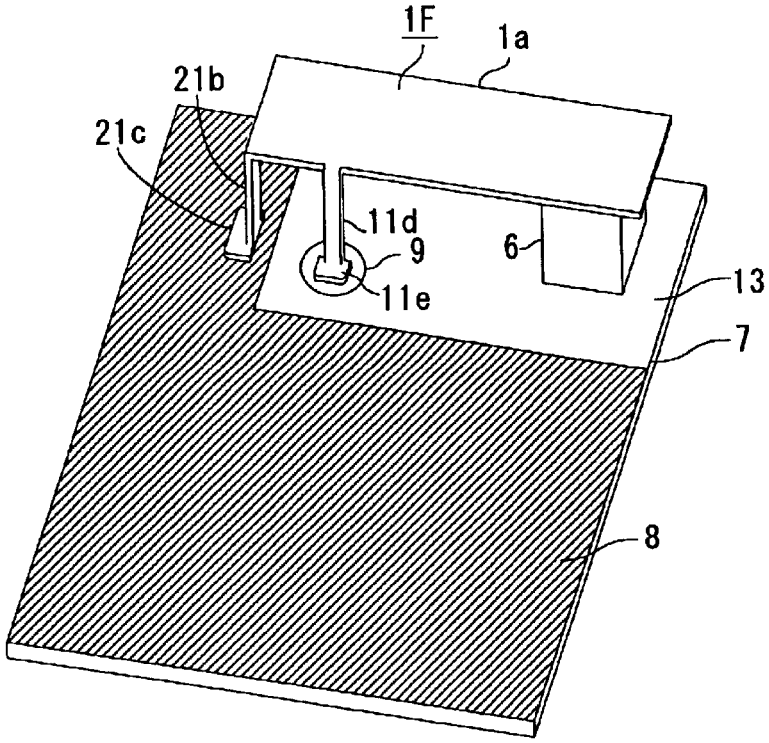
FIG. 8 is an external perspective view of the inverted-F plate antenna of a seventh embodiment of the invention, in its mounted state.

A seventh embodiment of the present invention will be described below with reference to the drawings. FIG. 8 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1F is mounted on a printed circuit board 7 having a ground pattern 8 formed over its top surface except in an area 13 as in the first embodiment (FIG. 1). This inverted-F plate antenna 1F, like the inverted-F plate antenna 1 of the first embodiment, has an elongate conductor portion 1*a*, a grounding conductor portion 21*b* having a mounting conductor portion 21*c*, and a feeding conductor portion 11*d* having a mounting conductor portion 11*e*. The grounding conductor portion 21*b* and the mounting conductor portion 21*c* are so shaped that the mounting conductor portion 21*c* has a larger width than the grounding conductor portion 21*b*. Moreover, the feeding conductor portion 11*d* and the mounting conductor portion 11*e* are so shaped that the mounting conductor portion 11*e* has a larger width than the feeding conductor portion 11*d*. Furthermore, between the free end of the elongate conductor portion 1*a* and the printed circuit board 7, a spacer 6 is provided.

The mounting conductor portion 21*c* and the mounting conductor portion 11*e* of this inverted-F plate antenna 1F are formed by cutting them out of sheet metal so that they have larger widths than the grounding conductor portion 21*b* and the feeding conductor portion 11*d*, respectively, and then bending them. Thus, even in cases where the grounding conductor portion 21*b* and the feeding conductor portion 11*d* have small widths, the mounting conductor portion 21*c* and the mounting conductor portion 11*e* have larger widths, and therefore the antenna 1F can be kept in position more securely, eliminating the need for the spacer 6 in cases where the elongate conductor portion 1*a* is short. In this embodiment, the mounting conductor portion 21*c* and the mounting conductor portion 11*e* are both made wider. However, it is also possible to make only one of them wider.

Eighth Embodiment

Figure 9:
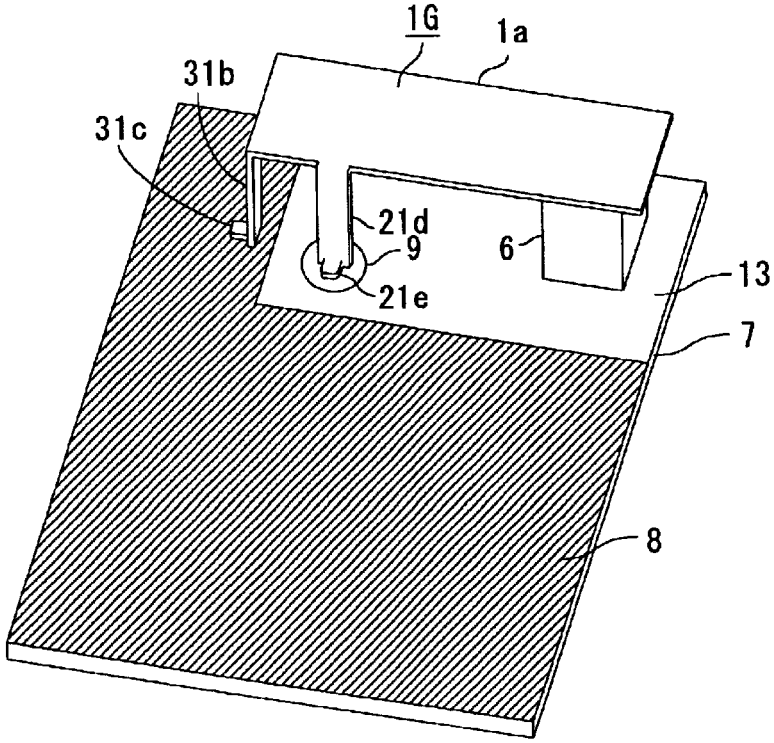
FIG. 9 is an external perspective view of the inverted-F plate antenna of an eighth embodiment of the invention, in its mounted state.

An eighth embodiment of the present invention will be described below with reference to the drawings. FIG. 9 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1G is mounted on a printed circuit board 7 having a ground pattern 8 formed over its top surface except in an area 13 as in the first embodiment (FIG. 1). This inverted-F plate antenna 1G, like the inverted-F plate antenna 1 of the first embodiment, has an elongate conductor portion 1*a*, a grounding conductor portion 31*b* having a mounting conductor portion 31*c*, and a feeding conductor portion 21*d* having a mounting conductor portion 21*e*. The grounding conductor portion 31*b* and the mounting conductor portion 31*c* are so shaped that the mounting conductor portion 31*c* has a smaller width than the grounding conductor portion 31*b*. Moreover, the feeding conductor portion 21*d* and the mounting conductor portion 21*e* are so shaped that the mounting conductor portion 21*e* has a smaller width than the feeding conductor portion 21*d*. Furthermore, between the free end of the elongate conductor portion 1*a* and the printed circuit board 7, a spacer 6 is provided.

The mounting conductor portion 31*c* and the mounting conductor portion 21*e* of this inverted-F plate antenna 1G are formed by cutting them out of sheet metal so that they have smaller widths than the grounding conductor portion 31*b* and the feeding conductor portion 21*d*, respectively, and then bending them. Thus, even in cases where the grounding conductor portion 31*b* and the feeding conductor portion 21*d* have large widths, the mounting conductor portion 31*c* and the mounting conductor portion 21*e* have smaller widths, and therefore the inverted-F plate antenna 1G can be mounted on the printed circuit board 7 with smaller areas occupied thereon. This makes it possible to secure a wider area in which to mount other components, and thus helps increase the flexibility in the design of the arrangement of components. In this embodiment, the mounting conductor portion 31*c* and the mounting conductor portion 21*e* are both made narrower. However, it is also possible to make only one of them narrower.

In the first to eighth embodiments, a spacer is provided to keep the inverted-F plate antenna securely in position. However, in cases where the inverted-F plate antenna can be kept securely in position on its own, it is not absolutely necessary to provide a spacer.

Ninth Embodiment

Figure 10:
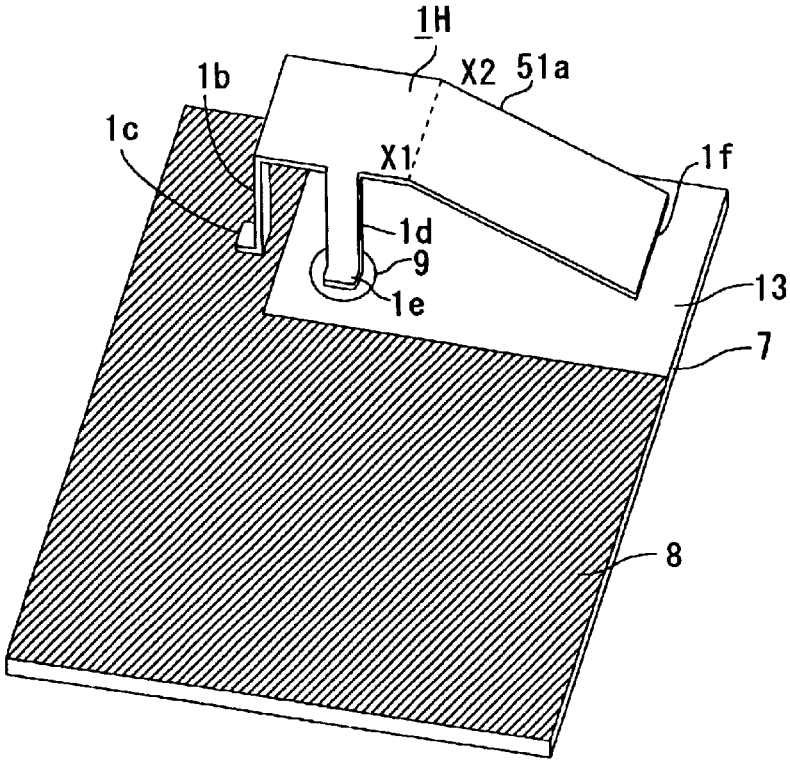
FIG. 10 is an external perspective view of the inverted-F plate antenna of a ninth embodiment of the invention, in its mounted state.

A ninth embodiment of the present invention will be described below with reference to the drawings. FIG. 10 is an external perspective view of the inverted-F plate antenna of this embodiment. It is to be noted that such elements as are found also in FIG. 3 are identified with the same reference numerals, and their detailed explanations will not be repeated.

In this embodiment, the inverted-F plate antenna 1H is mounted on a printed circuit board 7 having a ground pattern 8 formed over its top surface except in an area 13 as in the second embodiment (FIG. 3). This inverted-F plate antenna 1H, like the inverted-F plate antenna 1A of the second embodiment, has an elongate conductor portion 51*a*, a grounding conductor portion 1*b* having a mounting conductor portion 1*c*, and a feeding conductor portion 1*d* having a mounting conductor portion 1*e*. The elongate conductor portion 51*a* is bent along a line X1–X2 so that its free end If, i.e., the side opposite to the side A where the grounding conductor portion 1*b* is provided, makes contact with the printed circuit board 7.

The elongate conductor portion 51*a* of this inverted-F plate antenna 1H, like the elongate conductor portion 11*a* shown in FIG. 3, is formed by bending the elongate conductor portion 1*a* shown in FIG. 1 along the line X1–X2. As a result, when viewed from above the printed circuit board 7, the area occupied by the elongate conductor portion 51*a*, which determines the size of the inverted-F plate antenna 1H, is smaller than the area occupied by the elongate conductor portion 1*a*, which determines the size of the inverted-F plate antenna 1 shown in FIG. 1.

Moreover, since the elongate conductor portion 51*a* is so formed that its free end 1*f* makes contact with the printed circuit board 7, the volume occupied by the inverted-F plate antenna 1H is smaller than the volume occupied by the inverted-F plate antenna 1 shown in FIG. 1. Furthermore, the antenna 1H is now supported also at its free end, and therefore there is no need to provide a spacer. These features help miniaturize the antenna, and help increase the flexibility in the design of where to locate the supporting posts of the cabinet in which the printed circuit board 7 is housed.

Tenth Embodiment

Figure 11:
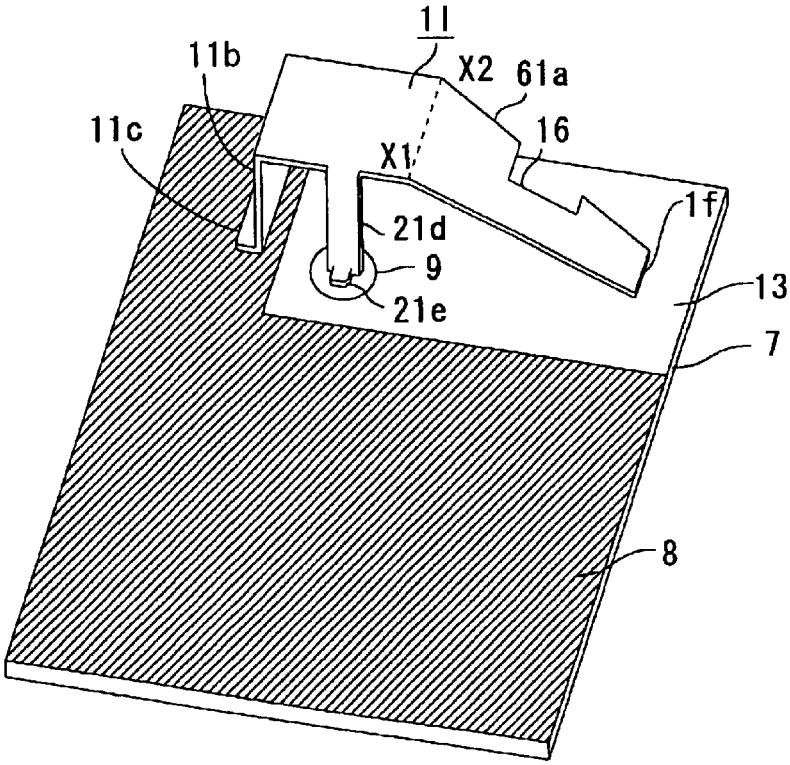
FIG. 11 is an external perspective view of the inverted-F plate antenna of a tenth embodiment of the invention, in its mounted state.

A tenth embodiment of the present invention will be described below with reference to the drawings. FIG. 11 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1I is mounted on a printed circuit board 7 having a ground pattern 8 formed over its top surface except in an area 13 as in the first embodiment (FIG. 1). This inverted-F plate antenna 1I, like the inverted-F plate antenna 1 of the first embodiment, has an elongate conductor portion 61*a*, a grounding conductor portion 11*b* having a mounting conductor portion 11*c*, and a feeding conductor portion 21*d* having a mounting conductor portion 21*e*.

The elongate conductor portion 61*a* is so shaped that its width decreases toward its free end 1*f*, like the elongate conductor portion 21*a* of the third embodiment (FIG. 4), is moreover so shaped as to have a cut 16 formed in the side opposite to the side B where the feeding conductor portion 1*d* is provided, like the elongate conductor portion 31*a* of the fourth embodiment (FIG. 5), and is furthermore bent along a line X1–X2 so that its free end 1*f* makes contact with the printed circuit board 7, like the elongate conductor portion 51*a* of the ninth embodiment (FIG. 10). In addition, as in the sixth embodiment (FIG. 7), the grounding conductor portion 11*b* and the mounting conductor portion 11*c* each have the same width as the elongate conductor portion 61*a* in its widest portion, and, as in the eighth embodiment (FIG. 9), the mounting conductor portion 21*e* has a smaller width than the feeding conductor portion 21*d*.

The inverted-F plate antenna of this embodiment is so structured as to have the features of the inverted-F plate antennas of the third, fourth, sixth, eighth, and ninth embodiments combined together. However, it is also possible to structure an inverted-F plate antenna in any other manner by combining together some of the features of the inverted-F plate antennas of the second to ninth embodiments otherwise. In this way, it is possible to produce an inverted-F plate antenna that best fits the shape of the cabinet in which to house the printed circuit board having the inverted-F plate antenna mounted thereon.

Eleventh Embodiment

Figure 12:
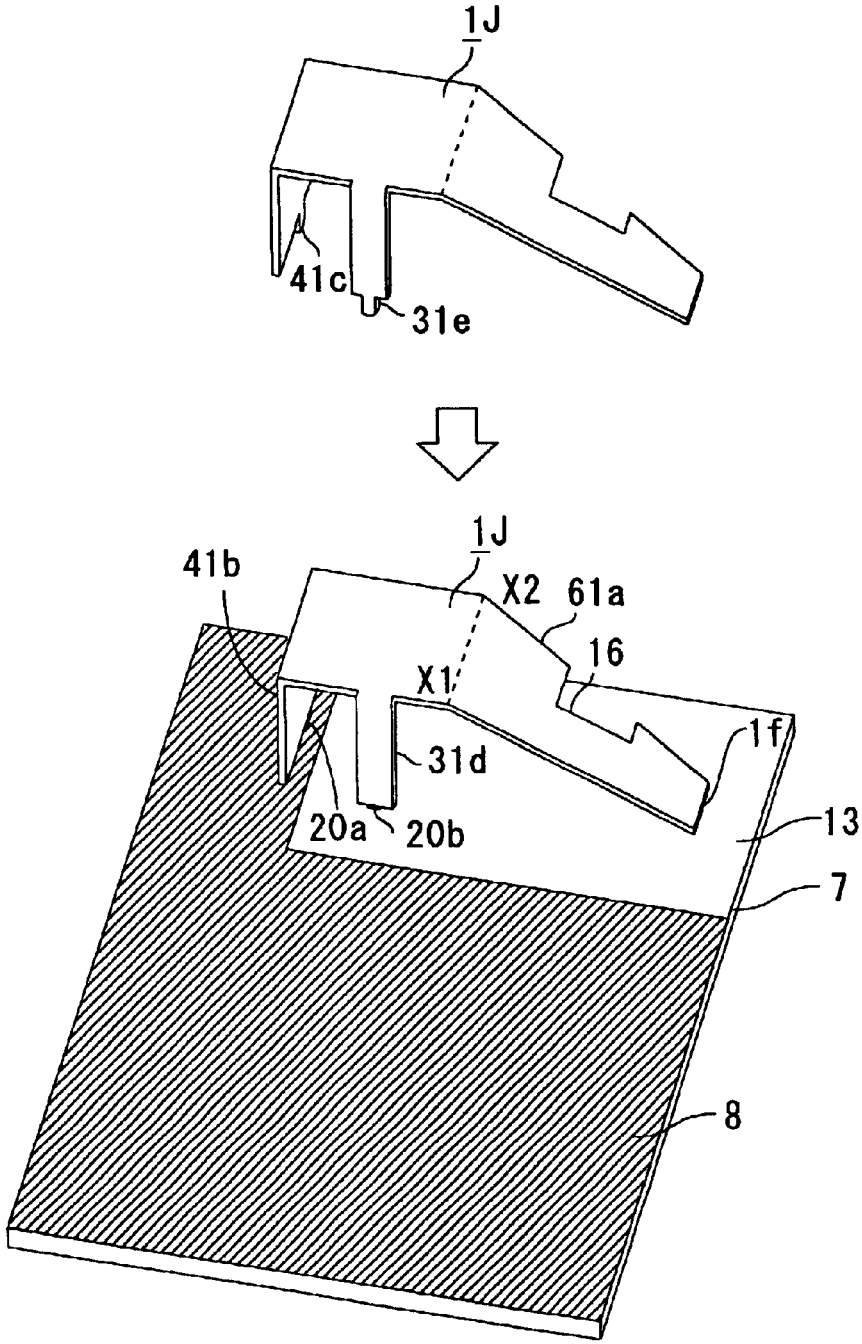
FIG. 12 is an external perspective view of the inverted-F plate antenna of an eleventh embodiment of the invention, in its mounted state.

An eleventh embodiment of the present invention will be described below with reference to the drawings. FIG. 12 is an external perspective view of the inverted-F plate antenna of this embodiment. It is to be noted that such elements as are found also in FIG. 11 are identified with the same reference numerals, and their detailed explanations will not be repeated.

In this embodiment, the inverted-F plate antenna 1J is mounted on a printed circuit board 7 having a ground pattern 8 formed over its top surface except in an area 13 as in the tenth embodiment (FIG. 11). This inverted-F plate antenna 1J has an elongate conductor portion 61*a*, a grounding conductor portion 41*b* having an inserting conductor portion 41*c*, and a feeding conductor portion 31*d* having an inserting conductor portion 31*e*. In the printed circuit board 7 are formed a through hole 20*a* that permits electrical connection to the ground pattern and a through hole 20*b* that permits electrical connection to a feeding point.

The grounding conductor portion 41*b* has the same width as the elongate conductor portion 61*a* in its widest portion. The inserting conductor portion 41*c* is so shaped as to protrude from the grounding conductor portion 41*b*, and is fitted into the through hole 20*a*. The inserting conductor portion 31*e* is so shaped as to protrude from the feeding conductor portion 31*d*, and is fitted into the through hole 20*b*. In this way, by fitting the inserting conductor portions 41*c* and 31*e* into the through holes 20*a* and 20*b*, respectively, it is possible to keep the inverted-F plate antenna 1J securely in position on the printed circuit board 7.

The inverted-F plate antenna of this embodiment is so structured as to have the features of the inverted-F plate antennas of the third, fourth, sixth, and ninth embodiments combined together. However, it is also possible to structure an inverted-F plate antenna in any other manner so as to have one of the features of the inverted-F plate antennas of the first to sixth and ninth embodiments, or some of those features combined together. In this way, it is possible to produce an inverted-F plate antenna that best fits the shape of the cabinet in which to house the printed circuit board having the inverted-F plate antenna mounted thereon.

Figure 13A:
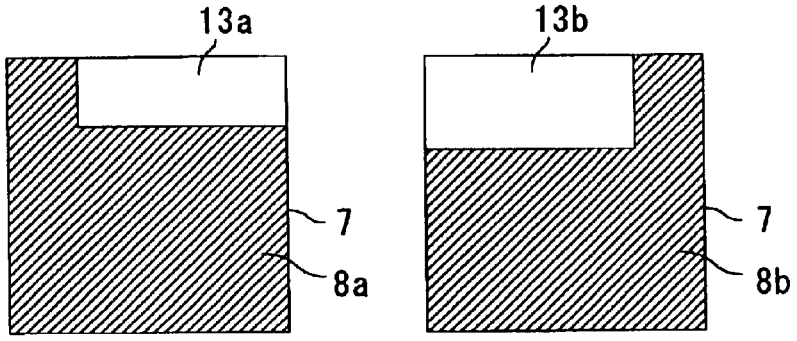
FIGS. 13A and 13B are diagrams showing the shapes of individual ground patterns when a plurality of ground patterns are formed on the printed circuit board.

In the first to eleventh embodiments described thus far, in cases where the printed circuit board 7 has ground patterns 8*a* and 8*b* formed over both its top and bottom surfaces, respectively, as shown in FIG. 13A, the ground patterns 8*a* and 8*b* are removed in areas 13*a* and 13*b* where the inverted-F plate antenna, one of 1 and 1A to 1J, is mounted. In these ground patterns 8*a* and 8*b*, the areas 13*a* and 13*b* need not be given identical shapes, but may be given different shapes to adjust the directivity patterns. In such cases, either the area 13*a* is so shaped that the mounting conductor portion 1*c* at the end of the grounding conductor portion 1*b* of the inverted-F plate antenna 1 is connected to the ground pattern 8*a*, or the area 13*b* is so shaped that the mounting conductor portion 1*c* is connected to the ground pattern 8*b* through a through hole.

Figure 13B:
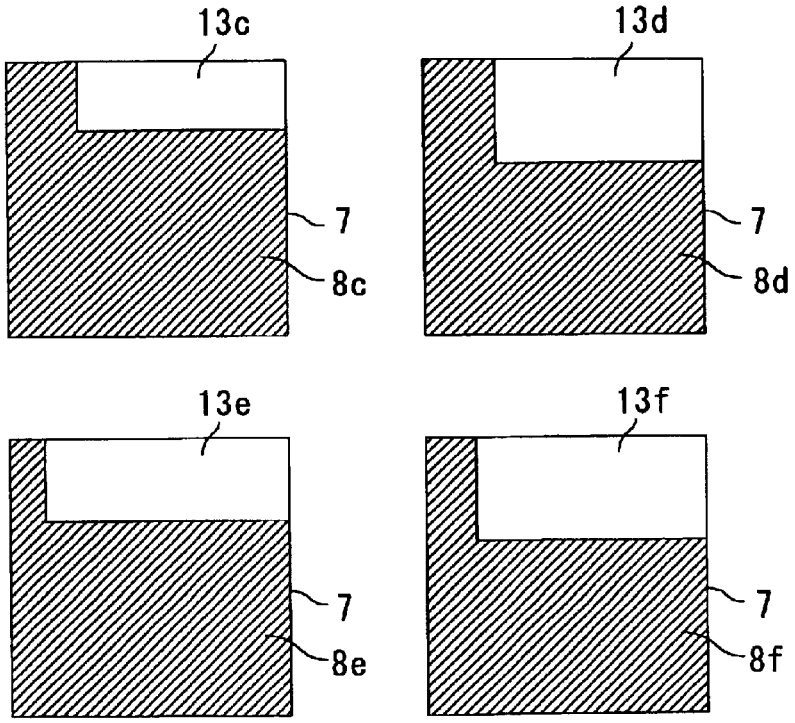

In cases where the printed circuit board 7 is of a four-layer type and has ground patterns 8*c* to 8*f* formed on its top surface, between the first and second layers, between the second and third layers, and between the third and fourth layers, respectively, as shown in FIG. 13B, the ground patterns 8*c* to 8*f* are removed in areas 13*c* to 13*f* where the inverted-F plate antenna 1 is mounted. Here also, as in the case shown in FIG. 13A, the areas 13*c* to 13*f* need not be given identical shapes, but may be given different shapes to adjust the directivity patterns. In such cases, the areas 13*c* to 13*f* are so shaped that the mounting conductor portion 1*c* at the end of the grounding conductor portion 1*b* of the inverted-F plate antenna 1 is electrically connected to one of the ground patterns 8*c* to 8*f*.

Here, a printed circuit board of a four-layer type is taken up as an example of a printed circuit board composed of multiple layers. However, it is also possible to use a multiple-layer printed circuit board of any other type instead. In cases where a ground pattern is formed also on the bottom surface of such a multiple-layer printed circuit board, it is given a shape similar to those formed on the top surface of and between the layers of the printed circuit board, as in the case shown in FIG. 13A, where ground patterns are formed on both the top and bottom surfaces of the printed circuit board.

In the first to eleventh embodiments, the ground pattern formed on the printed circuit board is so shaped as to avoid an area located under the elongated conductor portion of the inverted-F plate antenna. However, the ground pattern may be so shaped as to avoid not the whole area located under the elongated conductor portion but only part of that area. It is to be noted, however, that, in cases where the free end of the elongate conductor portion makes contact with the printed circuit board as in the ninth embodiment, the ground pattern inevitably needs to be so shaped as to avoid where the free end of the elongate conductor portion makes contact therewith.

Twelfth Embodiment

Figure 14:
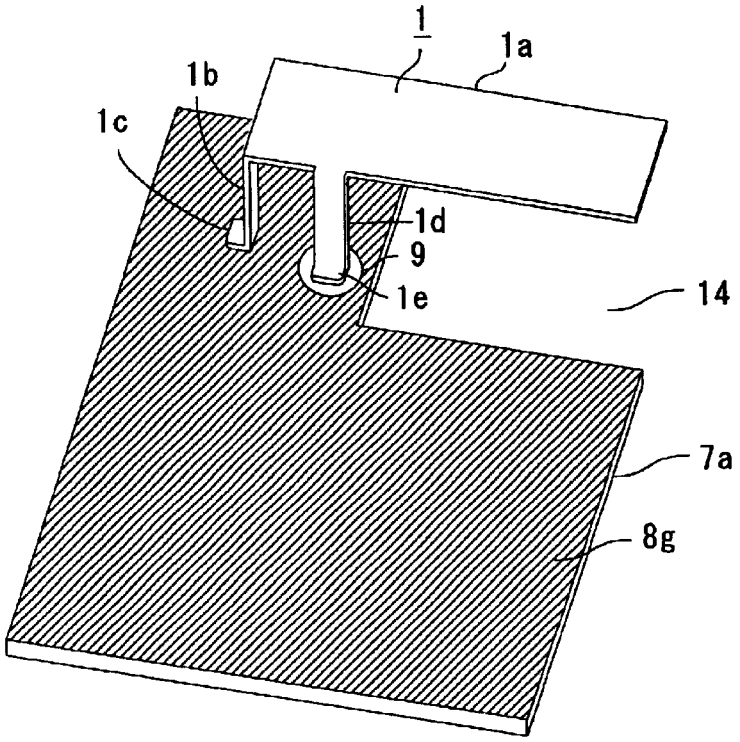
FIG. 14 is an external perspective view of the inverted-F plate antenna of a twelfth embodiment of the invention, in its mounted state.

A twelfth embodiment of the present invention will be described below with reference to the drawings. FIG. 14 is an external perspective view of the inverted-F plate antenna of this embodiment. It is to be noted that such elements as are found also in FIG. 1 are identified with the same reference numerals, and their detailed explanations will not be repeated.

In this embodiment, the inverted-F plate antenna 1 has the same shape as in the first embodiment (FIG. 1). This inverted-F plate antenna 1 is mounted on the top surface of a printed circuit board 7*a* of which a portion is cut out in an area 14 located under the elongate conductor portion 1*a* of the inverted-F plate antenna 1. This printed circuit board 7*a* has a ground pattern 8*g* formed all over its top surface. Thus, the mounting conductor portion 1*c* at the end of the grounding conductor portion 1*b* of the inverted-F plate antenna 1 is fitted on the ground pattern 8*g* and is thereby electrically connected thereto. Since the printed circuit board 7*a* has the portion thereof cut out in the area 14, there is no need to provide a spacer 6.

In this way, by cutting out a portion of the printed circuit board 7*a* in an area 14 located under the elongate conductor portion 1*a* of the inverted-F plate antenna 1, it is possible, as in the first embodiment, and thus in contrast to the case shown in FIG. 17, to obtain less lopsided directivity patterns and achieve a higher degree of isotropy for both vertically and horizontally polarized radio waves.

In this embodiment, a printed circuit board 7*a* having a ground pattern 8*g* formed over its top surface is taken up as an example. However, as in the first to eleventh embodiments, it is also possible to use instead a printed circuit board having ground patterns formed on both its top and bottom surfaces, or a multiple-layer printed circuit board having ground patterns formed between the individual layers thereof In such cases, the individual ground patterns may be given different shapes to adjust the directivity patterns.

In this embodiment, an inverted-F plate antenna that has the same shape as the inverted-F plate antenna 1 of the first embodiment is used. However, it is also possible to use instead one of the inverted-F plate antennas 1A to 1J of the second to eleventh embodiments. In such cases, there is no need to provide a spacer even with the type of inverted-F plate antenna that originally requires one.

In this embodiment, the printed circuit board has a portion thereof cut out in an area located under the elongated conductor portion of the inverted-F plate antenna. However, the portion of the printed circuit board so cut out may cover not the whole area located under the elongated conductor portion but only part of that area. It is to be noted, however, that, in cases where the free end of the elongate conductor portion is bent so as to make contact with the printed circuit board as when an inverted-F plate antenna like that of the ninth embodiment is used, the printed circuit board inevitably needs to have a portion thereof cut out so that the free end of the elongate conductor portion does not make contact therewith.

Figure 15:
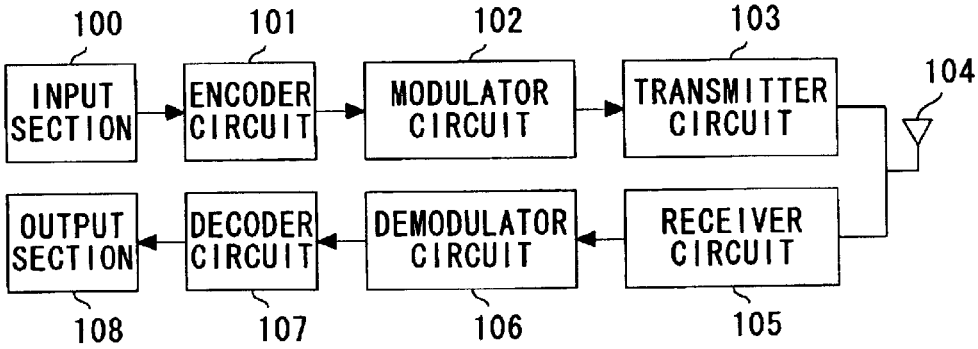
FIG. 15 is a block diagram showing the internal configuration of a wireless communication device incorporating an inverted-F plate antenna embodying the invention.

An Example of a Wireless Communication Device Incorporating an Antenna Embodying the Invention Hereinafter, a wireless communication device incorporating an antenna structured like those of the first to twelfth embodiments will be described. FIG. 15 is a block diagram showing the internal configuration of the wireless communication device of this embodiment.

The wireless communication device shown in FIG. 15 has an input section 100 to which sound, images, or data is fed from an external device, an encoder circuit 101 for encoding the data fed to the input section 100, a modulator circuit 102 for modulating the data encoded by the encoder circuit 101, a transmitter circuit 103 for amplifying the signal modulated by the modulator circuit 102 to produce a stable signal to be transmitted, an antenna 104 for transmitting and receiving signals, a receiver circuit 105 for amplifying the signals received by the antenna 104 and permitting only the signal within a predetermined frequency range to pass through, a demodulator circuit 106 for detecting and thereby demodulating the received signal amplified by the receiver circuit 105, a decoder circuit 107 for decoding the signal fed from the demodulator circuit 106, and an output section 108 for outputting the sound, images, or data decoded by the decoder circuit 107.

In this wireless communication device, first, the sound, images, or data fed to the input section 100 such as a microphone, a camera, or a keyboard is encoded by the encoder circuit 101. Then, by the modulator circuit 102, the encoded data is modulated with a carrier wave having a predetermined frequency. Then, the modulated signal is amplified by the transmitter circuit 103. The signal is then radiated as a transmitted signal by the antenna 104, which is built as an inverted-F plate antenna like those of the first to twelfth embodiments described earlier.

On the other hand, when signals are received by the antenna 104, first, the signals are amplified by the receiver circuit 105, and, by a filter circuit or the like provided in this receiver circuit 105, only the signal within a predetermined frequency range is permitted to pass through, and is thus fed to the demodulator circuit 106. Then, the demodulator circuit 106 detects and thereby demodulates the signal fed from the receiver circuit 105, and then the demodulated signal is decoded by the decoder circuit 107. The sound, images, or data obtained as a result of the decoding by the decoder circuit 107 is then output to the output section 108 such as a loudspeaker or a display.

In this wireless communication device, when an inverted-F plate antenna like those of the first to twelfth embodiments is used as the antenna 104, on the same circuit board on which the antenna 104 is formed, the encoder circuit 101, modulator circuit 102, transmitter circuit 103, receiver circuit 105, demodulator circuit 106, and decoder circuit 107 are also formed as circuit patterns.

Figure 16:
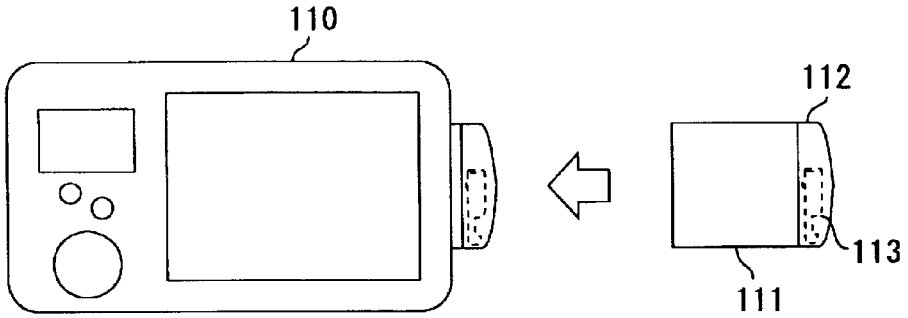
FIG. 16 is a diagram showing a CF card incorporating an inverted-F plate antenna embodying the invention.

The wireless communication device of this embodiment may be a PDA provided with wireless communication capability, or a CF card 111 provided with wireless communication capability and used while being inserted into a PDA 110 as shown in FIG. 16. When an inverted-F plate antenna 113 is housed in an antenna portion 112 of the CF card 111 as shown in FIG. 16, the CF card 111 is expected not to spoil the operability and appearance of the PDA into which it is inserted. Therefore, used here is an inverted-F plate antenna that is so structured as to have features of the embodiments described earlier and best fit the shape of the cabinet in which to house the printed circuit board on which the inverted-F plate antenna 113 is mounted.

According to the present invention, on a printed circuit board on which an inverted-F plate antenna is mounted, a portion of a ground pattern located under the inverted-F plate antenna is removed. This helps achieve, in the directivity patterns of the antenna, a higher degree of isotropy for both vertically and horizontally polarized radio waves. By using an inverted-F plate antenna mounted on a printed circuit board in this way, it is possible to transmit and receive signals with a single antenna without relying on a diversity system. In this way, it is possible to miniaturize and simplify antenna systems and wireless communication devices.

Moreover, by bending the elongated conductor portion of an inverted-F plate antenna or forming it so that its width decreases toward its open end, it is possible to reduce the volume occupied by the inverted-F plate antenna and thereby make the antenna compact. It is also possible to increase the flexibility in the design of the cabinet in which to house a printed circuit board. Moreover, by forming a cut or window in the elongated conductor portion of an inverted-F plate antenna, it is possible to increase the flexibility in the design of the cabinet in which to house a printed circuit board. Furthermore, by shaping the elongated conductor portion of an inverted-F plate antenna so that its free end makes contact with a printed circuit board, it is possible to keep the inverted-F plate antenna in position more securely without the provision of a spacer that is inserted between the inverted-F plate antenna and the printed circuit board to keep the antenna securely in position.

Moreover, by giving the grounding conductor portion of an inverted-F plate antenna a width exactly or nearly equal to that of the side of the elongate conductor portion at which it is provided, it is possible to easily form the grounding conductor portion. Moreover, by making at least one of the grounding and feeding conductor portions of an inverted-F plate antenna wider, or forming inserting conductor portions that are fitted into through holes, it is possible to keep the inverted-F plate antenna in position more securely. Moreover, by making at least one of the grounding and feeding conductor portions of an inverted-F plate antenna narrower, it is possible to increase the area for the placement of circuit components around the inverted-F plate antenna.

What is claimed is:

1. An inverted-F plate antenna comprising:

an elongate conductor portion having first and second lengthwise ends and provided so as to face a printed circuit board;

a grounding conductor portion provided at said first end of the elongate conductor portion and electrically connected to a ground pattern formed on the printed circuit board;

a feeding conductor portion provided between said first and second ends of the elongate conductor portion and electrically connected to a feeding point formed on the printed circuit board, wherein the ground pattern formed on the printed circuit board has a portion thereof removed along an entire length of an area under the elongate conductor portion between said feeding conductor portion and said second end of the elongate conductor portion.

2. An inverted-F plate antenna as claimed in claim 1, wherein the elongate conductor portion is bent at an arbitrary position so that a free end thereof opposite to where the grounding conductor portion is provided comes closer to the printed circuit board.

3. An inverted-F plate antenna as claimed in claim 2, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

4. An inverted-F plate antenna as claimed in claim 2, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

5. An inverted-F plate antenna as claimed in claim 2, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically connected to the feeding point.

6. An inverted-F plate antenna as claimed in claim 2, wherein, like the ground pattern, the printed circuit board itself has a portion thereof removed in part of an area facing the elongate conductor portion.

7. An inverted-F plate antenna as claimed in claim 2, wherein the elongate conductor portion is bent at an arbitrary position so that a free end thereof opposite to where the grounding conductor portion is provided makes contact with the printed circuit board.

8. An inverted-F plate antenna as claimed in claim 7, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

9. An inverted-F plate antenna as claimed in claim 7, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

10. An inverted-F plate antenna as claimed in claim 7, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically connected to the feeding point.

11. An inverted-F plate antenna as claimed in claim 7, wherein the printed circuit board has a plurality of ground patterns each having a portion thereof removed in part of an area facing the elongate conductor portion, each ground pattern being given a different shape from another.

12. An inverted-F plate antenna as claimed in claim 7, wherein, like the ground pattern, the printed circuit board itself has a portion thereof removed in part of an area facing the elongate conductor portion.

13. An inverted-F plate antenna as claimed in claim 1, wherein the elongate conductor portion is so shaped that a width thereof decreases toward a free end thereof opposite to where the grounding conductor portion is provided.

14. An inverted-F plate antenna as claimed in claim 13, wherein the elongate conductor portion is bent at an arbitrary position so that the free end thereof opposite to where the grounding conductor portion is provided comes closer to the printed circuit board.

15. An inverted-F plate antenna as claimed in claim 13, wherein the elongate conductor portion is bent at an arbitrary position so that the free end thereof opposite to where the grounding conductor portion is provided makes contact with the printed circuit board.

16. An inverted-F plate antenna as claimed in claim 13, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

17. An inverted-F plate antenna as claimed in claim 13, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

18. An inverted-F plate antenna as claimed in claim 13, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically connected to the feeding point.

19. An inverted-F plate antenna as claimed in claim 13, wherein the printed circuit board has a plurality of ground patterns each having a portion thereof removed in part of an area facing the elongate conductor portion, each ground pattern being given a different shape from another.

20. An inverted-F plate antenna as claimed in claim 13, wherein, like the ground pattern, the printed circuit board itself has a portion thereof removed in part of an area facing the elongate conductor portion.

21. An inverted-F plate antenna as claimed in claim 1, wherein the elongate conductor portion has a cut formed in an edge thereof.

22. An inverted-F plate antenna as claimed in claim 21, wherein the elongate conductor portion is bent at an arbitrary position so that the free end thereof opposite to where the grounding conductor portion is provided comes closer to the printed circuit board.

23. An inverted-F plate antenna as claimed in claim 21, wherein the elongate conductor portion is bent at an arbitrary position so that the free end thereof opposite to where the grounding conductor portion is provided makes contact with the printed circuit board.

24. An inverted-F plate antenna as claimed in claim 21, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

25. An inverted-F plate antenna as claimed in claim 21, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

26. An inverted-F plate antenna as claimed in claim 21, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically connected to the feeding point.

27. An inverted-F plate antenna as claimed in claim 21, wherein the printed circuit board has a plurality of ground patterns each having a portion thereof removed in part of an area facing the elongate conductor portion, each ground pattern being given a different shape from another.

28. An inverted-F plate antenna as claimed in claim 21, wherein, like the ground pattern, the printed circuit board itself has a portion thereof removed in part of an area facing the elongate conductor portion.

29. An inverted-F plate antenna as claimed in claim 1, wherein the elongate conductor portion has a window cut out in an arbitrary position.

30. An inverted-F plate antenna as claimed in claim 29, wherein the elongate conductor portion is bent at an arbitrary position so that the free end thereof opposite to where the grounding conductor portion is provided comes closer to the printed circuit board.

31. An inverted-F plate antenna as claimed in claim 29, wherein the elongate conductor portion is bent at an arbitrary position so that the free end thereof opposite to where the grounding conductor portion is provided makes contact with the printed circuit board.

32. An inverted-F plate antenna as claimed in claim 29, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

33. An inverted-F plate antenna as claimed in claim 29, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

34. An inverted-F plate antenna as claimed in claim 29, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically connected to the feeding point.

35. An inverted-F plate antenna as claimed in claim 29, wherein the printed circuit board has a plurality of ground patterns each having a portion thereof removed in part of an area facing the elongate conductor portion, each ground pattern being given a different shape from another.

36. An inverted-F plate antenna as claimed in claim 29, wherein, like the ground pattern, the printed circuit board itself has a portion thereof removed in part of an area facing the elongate conductor portion.

37. An inverted-F plate antenna as claimed in claim 1, wherein the grounding conductor portion has a width exactly or nearly equal to a width of the elongate conductor portion at the side thereof where the grounding conductor portion is provided.

38. An inverted-F plate antenna as claimed in claim 37, wherein the elongate conductor portion is bent at an arbitrary position so that the free end thereof opposite to where the grounding conductor portion is provided comes closer to the printed circuit board.

39. An inverted-F plate antenna as claimed in claim 37, wherein the elongate conductor portion is bent at an arbitrary position so that the free end thereof opposite to where the grounding conductor portion is provided makes contact with the printed circuit board.

40. An inverted-F plate antenna as claimed in claim 37, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

41. An inverted-F plate antenna as claimed in claim 37, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

42. An inverted-F plate antenna as claimed in claim 37, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically to the feeding point.

43. An inverted-F plate antenna as claimed in claim 37, wherein the printed circuit board has a plurality of ground patterns each having a portion thereof removed in part of an area facing the elongate conductor portion, each ground pattern being given a different shape from another.

44. An inverted-F plate antenna as claimed in claim 37, wherein, like the ground pattern, the printed circuit board itself has a portion thereof removed in part of an area facing the elongate conductor portion.

45. An inverted-F plate antenna as claimed in claim 1, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a greater width.

46. An inverted-F plate antenna as claimed in claim 45, wherein the printed circuit board has a plurality of ground patterns each having a portion thereof removed in part of an area facing the elongate conductor portion, each ground pattern being given a different shape from another.

47. An inverted-F plate antenna as claimed in claim 45, wherein, like the ground pattern, the printed circuit board itself has a portion thereof removed in part of an area facing the elongate conductor portion.

48. An inverted-F plate antenna as claimed in claim 1, wherein the grounding conductor portion and the feeding conductor portion are each provided with a mounting conductor portion that is mounted on the printed circuit board, and at least one of the grounding conductor portion and the feeding conductor portion has the mounting conductor portion thereof formed with a smaller width.

49. An inverted-F plate antenna as claimed in claim 48, wherein the printed circuit board has a plurality of ground patterns each having a portion thereof removed in part of an area facing the elongate conductor portion, each ground pattern being given a different shape from another.

50. An inverted-F plate antenna as claimed in claim 48, wherein, like the ground pattern, the printed circuit board itself has a portion thereof removed in part of an area facing the elongate conductor portion.

51. An inverted-F plate antenna as claimed in claim 1, wherein the grounding conductor portion is provided with an inserting conductor portion that is fitted into a first through hole electrically connected to the ground pattern formed on the printed circuit board and is thereby electrically connected to the ground pattern, and the feeding conductor portion is provided with an inserting conductor portion that is fitted into a second through hole electrically connected to the feeding point formed on the printed circuit board and is thereby electrically connected to the feeding point.

52. An inverted-F plate antenna as claimed in claim 51, wherein the printed circuit board has a plurality of ground patterns each having a portion thereof removed in part of an area facing the elongate conductor portion, each ground pattern being given a different shape from another.

53. An inverted-F plate antenna as claimed in claim 51, wherein, like the ground pattern, the printed circuit board itself has a portion thereof removed in part of an area facing the elongate conductor portion.

54. An inverted-F plate antenna as claimed in claim 1, wherein the printed circuit board has a plurality of ground patterns each having a portion thereof removed in part of an area facing the elongate conductor portion, each ground pattern being given a different shape from another.

55. An inverted-F plate antenna as claimed in claim 1, wherein, like the ground pattern, the printed circuit board itself has a portion thereof removed in part of an area facing the elongate conductor portion.

56. An inverted-F plate antenna comprising:

an elongate conductor portion provided so as to face a printed circuit board;

a grounding conductor portion provided at one side of the elongate conductor portion and electrically connected to a ground pattern formed on the printed circuit board;

a feeding conductor portion provided at one side of the elongate conductor portion and electrically connected to a feeding point formed on the printed circuit board, wherein the ground pattern formed on the printed circuit board has a portion thereof removed in part of an area facing the elongate conductor portion, and wherein the printed circuit board has a plurality of ground patterns each of said plurality of ground patterns having a portion thereof removed in part of an area facing the elongate conductor portion, and each of the plurality of ground patterns being of a different shape from another.

57. A wireless communication device comprising: an inverted-F plate antenna for at least either transmitting a communication signal to outside or receiving a communication signal from outside, the inverted-F plate antenna comprising:

an elongate conductor portion provided so as to face a printed circuit board; a grounding conductor portion provided at one side of the elongate conductor portion and electrically connected to a ground pattern formed on the printed circuit board; a feeding conductor portion provided at one side of the elongate conductor portion and electrically connected to a feeding point formed on the printed circuit board, wherein the ground pattern formed on the printed circuit board has a portion thereof removed in part of an area on the printed circuit board facing the elongate conductor portion so that the ground pattern is not present in a majority of the area on the printed circuit board facing the elongate conductor portion.

* * * * *